US005957459A

United States Patent [19]

Chae

[11] Patent Number: 5,957,459

[45] Date of Patent: Sep. 28, 1999

[54] BANKING CARD GAME

[76] Inventor: Myung Joo Chae, 3790 Narrow Leaf, Las Vegas, Nev. 89117

[21] Appl. No.: 09/067,754

[22] Filed: Apr. 27, 1998

[51] Int. Cl.[6] ..... A63F 1/00

[52] U.S. Cl. ..... 273/292

[58] Field of Search ..... 273/292, 274; 463/12

[56] References Cited

U.S. PATENT DOCUMENTS

| | | | |
|---|---|---|---|
| 5,257,810 | 11/1993 | Schorr et al. | 273/292 |
| 5,362,064 | 11/1994 | Lofink et al. | 273/292 |
| 5,395,119 | 3/1995 | Jacob et al. | 273/274 |
| 5,876,283 | 3/1999 | Parra et al. | 463/12 |

*Primary Examiner*—Benjamin H. Layno

[57] ABSTRACT

A game utilizes point values similar to those encountered in Baccarat and Chemin de Fer. The game is started by a player having an option of wagering that a point value of a player hand is either lower (Low), higher (High) or equal to a point value of a bank hand or a Zero wager that a hand includes cards with three zero point values, referred to as a triple zero. The player and bank hands are created by dealing two player cards and two bank cards from six decks of cards that are shuffled together. When a hand has a zero point value, it is augmented by additional cards until it either has a non-zero point value or becomes the triple zero. When the triple zero occurs, the only winning wager is the Zero wager. The player's wager is resolved and the game ends when either the point values of the player and bank hands are non-zero or the triple zero occurs. There is an option of insuring the Low and High wagers against the triple zero when augmenting a hand with a card having the zero point value would result in the triple zero. Additionally, the player has an option of doubling the Low wager and the High wager when one hand has a point value of 3, 4, 5, 6 or 7 and augmenting the other hand by a card having the zero point value would result in the triple zero.

8 Claims, 1 Drawing Sheet

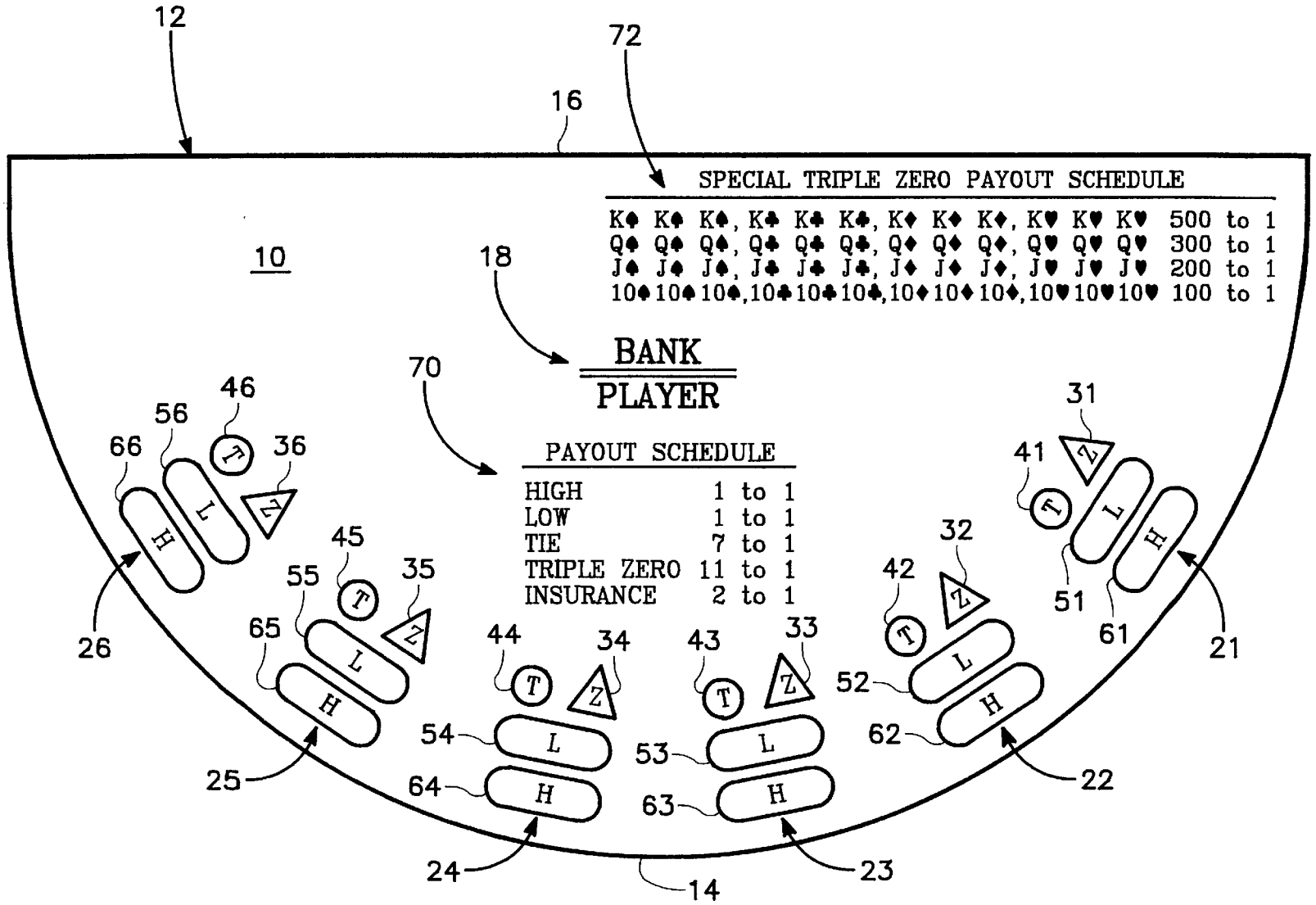
SPECIAL TRIPLE ZERO PAYOUT SCHEDULE
K♠ K♠, K♣ K♣, K♦ K♦, K♥ K♥ 500 to 1
Q♠ Q♠, Q♣ Q♣, Q♦ Q♦, Q♥ Q♥ 300 to 1
J♠ J♠, J♣ J♣, J♦ J♦, J♥ J♥ 200 to 1
10♠10♠,10♣10♣,10♦10♦,10♥10♥ 100 to 1
BANK
PLAYER
PAYOUT SCHEDULE
HIGH 1 to 1
LOW 1 to 1
TIE 7 to 1
TRIPLE ZERO 11 to 1
INSURANCE 2 to 1
10
12
14
16
18
21
22
23
24
25
26
31
32
33
34
35
36
41
42
43
44
45
46
51
52
53
54
55
56
61
62
63
64
65
66
70
72

BANKING CARD GAME

BACKGROUND OF THE INVENTION

1. Field of Invention

This invention is in the general field of casino gaming and, more particularly, is a banking card game with easily understood rules.

2. Description of the Prior Art

In a banking card game, one or more players usually play against a bank which, parenthetically, is usually another player. Examples of banking card games are Baccarat, Punto Banco and Chemin de Fer.

Baccarat and Chemin de Fer are typically played with two hands of cards dealt from eight standard decks of cards that are shuffled together. The two hands are a player hand and a bank hand. A winner is determined by comparing point values of the hands.

The point value of an exemplary hand is obtained from the sum of the point values of cards that comprise the exemplary hand. Kings, Queens and Jacks have a point value of zero. All other cards have a point value equal to their numerical face value with an ace having a point value of one.

When the sum is a one digit number, the sum is the point value of the exemplary hand. When the sum is a two digit number, the low order digit of the sum is the point value of the exemplary hand.

Rules for banking card games are usually numerous. In addition to being numerous, the rules are usually arcane. The arcane rules notwithstanding, Americans are reported to spend over $1.5 billion per year on Baccarat and Chemin de Fer, for example. Accordingly, banking card games enjoy a large core measure of popularity.

Because of the numerous arcane rules of the banking card games of the prior art, there is a need for a new banking card game with a few easily under understood rules. The easily understood rules would cause the new banking card game to be more popular than the banking card games of the prior art.

SUMMARY OF THE INVENTION

An object of the present invention is to provide a banking card game that is easy to play.

Another object of the invention is to provide a game with features that capture the interest of casino patrons.

According to the present invention, a game utilizes point values similar to those encountered in Baccarat and Chemin de Fer.

The game is started by a player having an option of wagering that a point value of a player hand is either lower, higher or equal to a point value of a bank hand. Additionally, the player may wager that a hand includes cards with a predetermined number of zero point values.

Two player cards and two bank cards are dealt from one or more standard decks of cards that are shuffled together, thereby creating the player hand and the bank hand, respectively. When a hand has the zero point value, it is augmented by additional cards until it either has a non-zero point value or includes cards with the predetermined number of zero point values. The player's wager is resolved and the game ends when either the point values of the player and bank hands are non-zero or a hand has the predetermined number of zero point values.

The invention is a banking card game that is easier to understand than Baccarat. Additionally, the game is structured to provide situations that are the subject matter of wagers of a type that capture the interest of casino patrons.

Other objects, features, and advantages of the invention should be apparent from the following description of the preferred embodiment thereof as illustrated in the accompanying drawing.

BRIEF DESCRIPTION OF THE DRAWING

The sole FIGURE herein is a plan view of a surface where cards are placed by a dealer and cheques are placed by a player.

DESCRIPTION OF THE PREFERRED EMBODIMENT

A game in accordance with the preferred embodiment utilizes six standard decks of cards that are shuffled together and placed within what is known as a shoe. The cards have point values similar to those encountered in Baccarat and Chemin de Fer. In an alternative embodiment, other than six decks of cards are utilized.

The game is started by a player wagering that a point value of a player hand is either lower, higher or equal to a point value of a bank hand. Additionally, the player may wager that a hand will include cards with three zero point values. The lower, higher, equal and zero point value wagers are hereinafter referred to as Low, High, Tie and Zero wagers, respectively.

As shown in the drawing, the game is played with the aid of a semi-circular top surface 10 of a table. The surface 10 is usually made from green felt.

The surface 10 has a straight edge 12 and an arcuate edge 14. A dealer (not shown) is usually positioned near a station 16 at the center of the edge 12.

A card dispensing area 18 of the surface 10 is adjacent to the station 16. Lettering of the word, PLAYER, and the word, BANK, separated by a double line, is carried within the area 18. The dealer dispenses cards that comprise the player and bank hands in the area 18 near the lettering of the words PLAYER and BANK, respectively.

The surface 10 additionally carries groups of wagering indicia 21–26 that are evenly spaced along an arcuate path adjacent to the edge 14. As explained hereinafter, a wager is made by placing cheques representative of the wager within an indicium of the groups 21–26.

The group 21 includes an indicium 31 in the shape of an equilateral triangle that is circumscribed about the letter, Z. The groups 22–26 include indicia 32–36, respectively, that are similar to the indicium 31. The Zero wager is made by placing cheques representative of the Zero wager within one of the indicia 31–36.

The group 21 includes an indicium 41 that is carried alongside the indicium 31. The indicium 41 is in the shape of a circle that is circumscribed about the letter, T. The groups 22–26 include indicia 42–46, respectively, that are similar to the indicium 41. The Tie wager is made by placing cheques representative of the Tie wager within one of the indicia 41–46.

The group 21 additionally includes an indicium 51 that is carried between the edge 14 and the indicia 31, 41. The indicium 51 is in the shape of an oval that is circumscribed about the letter, L. The groups 22–26 include indicia 52–56, respectively, that are similar to the indicium 51. The Low wager is made by placing cheques representative of the Low wager within one of the indicia 51–56.

The group 21 further includes an indicia 61 that is carried between the edge 14 and the indicium 51. The indicium 61 is in the shape of an oval that is circumscribed about the letter, H. The groups 22–26 include indicia 62–66, respectively, that are similar to the indicium 61. The High wager is made by placing cheques representative of the High wager within one of the indicia 51–56.

After the wager is made, two cards comprising an initial bank hand are dealt from the shoe onto the area 18 near the word, BANK. Additionally, two cards comprising an initial player hand are dealt from the shoe onto the area 18 near the word, PLAYER. Preferably, the cards of the initial hands are dealt alternately with a card of the bank hand being dealt first.

When the initial hands have non-zero point values, the wager is resolved and the game ends. It should be understood that when the player and bank hands have non-zero point values, the only possible winning wagers are the High, Low and Tie wagers.

When an initial hand has the zero point value, it is augmented by cards dealt from the shoe until either it has a non-zero point value or includes cards with three zero point values. A hand with the three zero point values is referred to hereinafter as a triple zero. It should be understood that the game ends when the triple zero occurs. Therefore, there can be only one triple zero during the game. Examples of the triple zero are given as follows:

(a) 8♣ 2♦ 10♥ J♦ where 8♣ 2♦ comprise cards of an initial hand that is augmented to become the triple zero;

(b) 10♥ J♦ K♥; and (c) K♥ K♥ K♥.

A result of the triple zero is that the only winning wager is the Zero wager. The triple zero causes players to lose half of their High and Low wagers and all of their Tie wagers.

The surface 10 carries lettering of a payout schedule 70 that describes payouts to a player who wins a wager. Preferably, there is a special payout schedule providing for a payout on the Zero wager in accordance with lettering of a schedule 72 on the surface 10. More particularly, the special payout schedule is given as follows:

three kings of the same suit 500 to 1;

three queens of the same suit 300 to 1;

three jacks of the same suit 200 to 1; and three tens of the same suit 100 to 1.

Preferably, the game includes an option of insuring the High wager and the Low wager against the triple zero. Insurance may be purchased when augmenting a hand by a card with the zero point value would result in the triple zero. The premium for the insurance is up to the full amount of the wager that is being insured. When the insurance is purchased and the triple zero occurs, there is a payout on the amount of the premium in accordance with the schedule 70.

This embodiment includes an option of doubling the High wager and the Low wager when one hand has a point value of either 3, 4, 5, 6 or 7 and augmenting the other hand by a card with the zero point value would result in the triple zero.

The following are examples of play of the game.

EXAMPLE 1

A first player makes the Zero wager by placing cheques within the indicium 31.

A second player makes the Tie wager by placing cheques within the indicium 42.

A third player makes the Low wager by placing cheques within the indicium 53.

A fourth player makes the High wager by placing cheques within the indicium 64.

The initial bank hand is: 6♠, 7♥

The initial player hand is: 10♦, 9♦

The initial bank and player hands have point values of 3 and 9, respectively. Therefore, the fourth player wins a 1 to 1 payout in accordance with the schedule 70. All other players lose their wagers.

EXAMPLE 2

A first player makes the Zero wager by placing cheques within the indicium 31.

A second player makes the Tie wager by placing cheques within the indicium 42.

A third player makes the Low wager by placing cheques within the indicium 53.

A fourth player makes the High wager by placing cheques within the indicium 64.

The initial bank hand is: 6♠, 4♥

The initial player hand is: 10♦, A♦

The player hand has a point value of 1.

The initial bank hand has the zero point value. Therefore, the initial bank hand must be augmented by at least one additional card. With the one additional card, the augmented bank hand is:

6♠, 4♥, 5♠

The augmented bank hand has a point value of 5 resulting in the third player winning a 1 to 1 payout in accordance with the schedule 70. All other players lose their wagers.

EXAMPLE 3

A first player makes the Zero wager by placing cheques within the indicium 31.

A second player makes the Tie wager by placing cheques within the indicium 42.

A third player makes the Low wager by placing cheques within the indicium 53.

A fourth player makes the High wager by placing cheques within the indicium 64.

The initial bank hand is: 6♠, 4♥

The initial player hand is: 10♦, 3♦

The player hand has a point value of 3.

The initial bank hand has the zero point value. Therefore, the initial bank hand must be augmented by at least one additional card. With the one additional card, the augmented bank hand is:

6♠, 4♥,K♣

Therefore, with the one additional card, the augmented bank hand has the zero point value.

Further augmentation of the bank hand by a card with the zero point value would result in the triple zero. Because the third and fourth players made the Low and High wagers, respectively, they have the option of insuring their wagers. Moreover, since the player hand has the point value of 3, the third and fourth players additionally have the option of doubling their wagers.

The third player decides to:

(a) double the low wager; and (b) insure the doubled low wager with a premium equal to one half of the amount of the doubled wager.

When the augmented bank hand is further augmented by a second additional card, the augmented bank hand is:

6♠, 4♥,K♣, 5♥

Therefore, with the two additional cards the bank hand has a point value of 5, resulting in the third player winning a 1 to 1 payout in accordance with the schedule 70. All other players lose their wagers.

EXAMPLE 4

A first player makes the Zero wager by placing cheques within the indicium 31.

A second player makes the Tie wager by placing cheques within the indicium 42.

A third player makes the Low wager by placing cheques within the indicium 53.

A fourth player makes the High wager by placing cheques within the indicium 64.

The initial bank hand is: 6♠, 4♥

The initial player hand is: 10♦, 3♦

The initial player hand has a point value of 3.

The initial bank hand has the zero point value. Therefore, the initial bank hand must be augmented by at least one additional card. With the one additional card, the augmented bank hand is:

6♠, 4♥,K♣

Therefore, with the one additional card, the augmented bank hand has the zero point value.

Further augmentation of the bank hand by a card with the zero point value would result in the triple zero. Because the third and fourth players made the Low and High wagers, respectively, they have the option of insuring their wagers. Moreover, since the final player hand has the point value of 3, the third and fourth players additionally have the option of doubling their wagers.

The third player decides to:

(a) double the low wager; and (b) insure the doubled low wager with a premium equal to the full amount of the doubled low wager.

The augmented bank hand must be further augmented by a second additional card. With the second additional card, the augmented bank hand is:

6♠, 4♥,K♣, 10♥

Therefore, with the two additional cards the final bank hand is a triple zero, resulting in the third and fourth players losing one half of their wagers. However, in accordance with the schedule 70, the third player wins a 2 to 1 payout on the insurance. In further accord with the schedule 70, the first player wins an 11 to 1 payout on the Zero wager. The second player loses the Tie wager.

While the invention has been particularly shown and described with reference to a preferred embodiment thereof, it should be understood by those skilled in the art that changes in form and detail may be made therein without departing from the spirit and scope of the invention.

I claim:

1. The method of playing a banking game that utilizes card point values similar to those encountered in Baccarat and Chemin de Fer, comprising the steps of:

shuffling together one or more standard decks of cards;

providing a player with an option of making (a) a High wager that a point value of a player hand is higher than a point value of a bank hand;

(b) a Low wager that the point value of the player hand is lower than the point value of the bank hand;

(c) a Tie wager that the point value of the player hand is equal to the point value of the bank hand; or (d) a Zero wager that a hand includes cards with a predetermined number of zero point values;

dealing two player cards and two bank cards from said shuffled decks, thereby creating a player hand and a bank hand, respectively; and augmenting a hand having the zero point value with additional cards until it either has a non zero point value or includes cards with said predetermined number of zero point values, said game ending either when said player and banker hands have non zero point values or a hand includes cards with said predetermined number of zero point values, said Zero wager being the only winning wager when a hand includes cards with said predetermined number of zero point values.

2. In the method of claim 1 wherein said predetermined number is three, whereby a hand that includes cards with three zero point values is a triple zero.

3. In the method of claim 2 wherein six decks are shuffled together.

4. In the method of claim 3, the additional step of making a special payout on said Zero wager in accordance with a schedule which is given as:

three kings of the same suit 500 to 1;

three queens of the same suit 300 to 1;

three jacks of the same suit 200 to 1; and three tens of the same suit 100 to 1.

5. In the method of claim 3, the additional step of causing said triple zero to result in a loss of one half of all High and Low wagers and the entire amount of said Tie wager.

6. In the method of claim 3, the additional step of giving said player an option of insuring a High wager and a Low wager against said triple zero when augmenting a hand with the zero point value with one card could result in said triple zero.

7. In the method of claim 6 wherein a premium for said insurance is up to the entire amount of an insured wager.

8. In the method of claim 7, the additional step of making a payout to a player in accordance with a schedule which is given as:

| PAYOUT SCHEDULE | |
|---|---|
| High | 1 to 1 |
| Low | 1 to 1 |
| Tie | 7 to 1 |
| Zero | 11 to 1 |
| Insurance | 2 to 1 |

.

* * * * *